US010938162B2

(12) United States Patent
Lin

(10) Patent No.: US 10,938,162 B2
(45) Date of Patent: Mar. 2, 2021

(54) ELECTRICAL CONNECTOR WITH GROUND PLATE CONNECTED TO GROUND CONTACTS

(71) Applicant: LOTES CO., LTD, Keelung (TW)

(72) Inventor: Chin Chi Lin, Keelung (TW)

(73) Assignee: LOTES CO., LTD, Keelung (TW)

( * ) Notice: Subject to any disclaimer, the term of this patent is extended or adjusted under 35 U.S.C. 154(b) by 0 days.

(21) Appl. No.: 16/716,679

(22) Filed: Dec. 17, 2019

(65) Prior Publication Data

US 2020/0244014 A1 Jul. 30, 2020

(30) Foreign Application Priority Data

Jan. 28, 2019 (CN) ..... 201910079011.6

(51) Int. Cl.

| | |
|---|---|
| ***H01R 13/6597*** | (2011.01) |
| ***H01R 13/6471*** | (2011.01) |
| ***H01R 13/426*** | (2006.01) |
| *H01R 13/6591* | (2011.01) |
| *H01R 4/04* | (2006.01) |
| *H01R 13/41* | (2006.01) |
| *H01R 12/72* | (2011.01) |
| *H01R 13/15* | (2006.01) |
| *H01R 13/6596* | (2011.01) |

(Continued)

(52) U.S. Cl.

CPC ..... *H01R 13/6597* (2013.01); *H01R 13/426* (2013.01); *H01R 13/6471* (2013.01); *H01R 4/04* (2013.01); *H01R 12/724* (2013.01); *H01R 12/727* (2013.01); *H01R 13/15* (2013.01); *H01R 13/245* (2013.01); *H01R 13/41* (2013.01); *H01R 13/6588* (2013.01); *H01R 13/6591* (2013.01); *H01R 13/6596* (2013.01); *H01R 13/65914* (2020.08); *H01R 13/65917* (2020.08)

(58) Field of Classification Search

CPC ..... H01R 13/6597; H01R 13/6471; H01R 13/426; H01R 13/245; H01R 13/41; H01R 12/727; H01R 13/6588; H01R 13/15; H01R 12/724; H01R 4/04; H01R 13/6591; H01R 13/65914; H01R 13/65917; H01R 13/6596

USPC ..... 439/92, 607.34

See application file for complete search history.

(56) References Cited

U.S. PATENT DOCUMENTS

2019/0393634 A1* 12/2019 Kao ..... H01R 12/7005

FOREIGN PATENT DOCUMENTS

| | | |
|---|---|---|
| CN | 109004400 A | 12/2018 |
| TW | M553060 U | 12/2017 |

* cited by examiner

*Primary Examiner* — Abdullah A Riyami
*Assistant Examiner* — Justin M Kratt
(74) *Attorney, Agent, or Firm* — Locke Lord LLP; Tim Tingkang Xia, Esq.

(57) ABSTRACT

An electrical connector includes: an insulating body, having a mounting surface and a plurality of terminal slots concavely provided on the mounting surface; a grounding sheet, having a connecting arm and a plurality of abutting portions abutting the mounting surface; and at least one terminal, mounted to the insulating body along a backward-from-front direction. Each of the abutting portions is located at one side of a corresponding one of the terminal slots. An elastic sheet is located at an opening of one of the terminal slots, and is provided at one side of a corresponding abutting portion. The terminal abuts the elastic sheet. The terminal has a contact portion entering a corresponding one of the terminal slots to be electrically connected to a mating device.

18 Claims, 11 Drawing Sheets

(51) Int. Cl.
*H01R 13/6588* (2011.01)
*H01R 13/24* (2006.01)

ELECTRICAL CONNECTOR WITH GROUND PLATE CONNECTED TO GROUND CONTACTS

CROSS-REFERENCE TO RELATED PATENT APPLICATION

This non-provisional application claims priority to and the benefit of, pursuant to 35 U.S.C. § 119(a), patent application Serial No. CN201910079011.6 filed in China on Jan. 28, 2019. The disclosure of the above application is incorporated herein in its entirety by reference.

Some references, which may include patents, patent applications and various publications, are cited and discussed in the description of this disclosure. The citation and/or discussion of such references is provided merely to clarify the description of the present disclosure and is not an admission that any such reference is "prior art" to the disclosure described herein. All references cited and discussed in this specification are incorporated herein by reference in their entireties and to the same extent as if each reference were individually incorporated by reference.

FIELD

The present invention relates to an electrical connector, and more particularly to an electrical connector with a grounding sheet provided between an insulating body and terminals.

BACKGROUND

The background description provided herein is for the purpose of generally presenting the context of the disclosure. Work of the presently named inventors, to the extent it is described in this background section, as well as aspects of the description that may not otherwise qualify as prior art at the time of filing, are neither expressly nor impliedly admitted as prior art against the present disclosure.

An existing electrical connector includes an elongated insulating body, a plurality of signal terminals, a plurality of ground terminals and a grounding sheet. The grounding sheet has an elongated flat plate portion along the insulating body. The flat plate portion extends downward to form a plurality of elastic sheets. Each of two sides of the flat plate portion bends to form a fixing portion. The assembling steps of the electrical connector are as follows. Firstly, the signal terminals and the ground terminals are inserted into the insulating body. Secondly, the grounding sheet is mounted and fixed to two sides of the insulating body, such that the elastic sheets press on the ground terminals to form grounding loops where the elastic sheets abut the ground terminals, thereby realizing high frequency transmission of the signal terminals.

However, the flat plate portion is formed by extending in a lengthwise direction of the insulating body, and the fixing portions are provided on the two sides of the grounding sheet and fixed on the two sides of the insulating body. An abutting force generated by the elastic sheets and the ground terminals abutting each other is located on a relatively middle portion of the plate surface of the grounding sheet, such that the middle portion of the flat plate portion of the grounding sheet bends, thereby affecting normal and good contact conduction of the grounding sheet and the ground terminals, reducing the grounding performance of the grounding sheet, and affecting transmission of high frequency signals of the signal terminals.

Therefore, a heretofore unaddressed need to design an electrical connector exists in the art to address the aforementioned deficiencies and inadequacies.

SUMMARY

The present invention is directed to an electrical connector with a grounding sheet provided between an insulating body and terminals, so as to avoid bending of the grounding sheet in an assembling process.

To achieve the foregoing objective, the present invention adopts the following technical solutions.

An electrical connector includes: an insulating body, having a mounting surface and a plurality of terminal slots concavely provided on the mounting surface; a grounding sheet, having a connecting arm and a plurality of abutting portions abutting the mounting surface, wherein each of the abutting portions is located at one side of a corresponding one of the terminal slots, an elastic sheet is located at an opening of one of the terminal slots, and the elastic sheet is provided at one side of a corresponding one of the abutting portions; and at least one terminal, mounted to the insulating body along a backward-from-front direction, wherein the terminal abuts the elastic sheet, and the terminal has a contact portion entering a corresponding one of the terminal slots to be electrically connected to a mating device.

In certain embodiments, the electrical connector includes a plurality of terminals, wherein the terminals comprise a plurality of signal terminals and a plurality of ground terminals, the signal terminals are provided in pairs, and the ground terminals are provided at two sides of one of the pairs of the signal terminals.

In certain embodiments, each of the terminals has a base located below the contact portion, a side of the base adjacent to the corresponding one of the terminal slots has an inner sidewall, a side of the base away from the corresponding one of the terminal slots has an outer sidewall; and the elastic sheet abuts the inner sidewall of each of the ground terminals.

In certain embodiments, the base has a fixing portion extending downward, a first distance exists between the fixing portions of the two adjacent signal terminals, a second distance exists between the fixing portion of one of the signal terminals and the fixing portion of an adjacent one of the ground terminals, and the first distance is less than the second distance.

In certain embodiments, one side of the connecting arm extends to form the abutting portions and a plurality of elastic sheets, a side of each of the abutting portions located in the corresponding one of the terminal slots abuts the mounting surface, and the elastic sheets are located in front of the terminal slots and abut inner sidewalls of the ground terminals.

In certain embodiments, a first gap exists between the two adjacent ones of the abutting portions, a second gap exists between one of the elastic sheets and an adjacent one of the abutting portions, and the first gap is greater than the second gap.

In certain embodiments, two sides of the connecting arm symmetrically extend to form two rows of elastic sheets, and the two rows of elastic sheets are located in front of the terminal slots and abut inner sidewalls of the ground terminals.

In certain embodiments, the elastic sheet is provided with an extending portion and an urging portion bending and extending from the extending portion toward the base, and the urging portion abuts inner sidewalls of the ground terminals.

In certain embodiments, the mounting surface is provided with a supporting portion located below the terminal slots, and the connecting arm abuts the supporting portion.

In certain embodiments, the supporting portion is provided with at least one groove corresponding to the elastic sheet, and an inner wall surface of the groove is an inclined surface configured to accommodate the elastic sheet.

An electrical connector includes: an insulating body, provided with a mounting surface, wherein the mounting surface is concavely provided with at least one accommodating slot and a plurality of terminal slots, the terminal slots are in communication with the accommodating slot, and a rib is provided between two adjacent ones of the terminal slots; a grounding sheet, accommodated in the accommodating slot, wherein the grounding sheet comprises at least one abutting portion located in front of the rib and abutting the rib, at least one elastic sheet provided in front of the terminal slots and extending toward an opening of the accommodating slot, and a connecting arm connecting the abutting portion and the elastic sheet; and at least one terminal, mounted to the insulating body along a backward-from-front direction, wherein the terminal has a base entering the accommodating slot and abutting the elastic sheet, and the base has a contact portion inserted into a corresponding one of the terminal slots and electrically connected to a mating device.

In certain embodiments, a side of the base adjacent to the corresponding one of the terminal slots has an inner sidewall, a side of the base away from the corresponding one of the terminal slots has an outer sidewall; and the elastic sheet abuts the inner sidewall.

In certain embodiments, the mounting surface is provided with a plurality of accommodating slots, and a spacing portion exists between two adjacent ones of the accommodating slots.

In certain embodiments, the electrical connector includes a plurality of terminals, wherein the terminals comprise a plurality of signal terminals and a plurality of ground terminals, the signal terminals are provided in pairs, two adjacent ones of the signal terminals are provided at two sides of the spacing portion, and the ground terminals are provided at two sides of one of the pairs of the signal terminals.

In certain embodiments, the two sides of the spacing portion are provided with two protruding blocks, and the protruding blocks are provided below the terminal slots to prevent the signal terminals from being excessively inserted.

In certain embodiments, the mounting surface is provided with an elongated through slot and a plurality of accommodating slots, the through slot is provided below the accommodating slots and simultaneously runs through the accommodating slots; and the connecting arm is accommodated in the through slot.

In certain embodiments, the mounting surface is further provided with an elongated supporting portion located below the through slot, and the connecting arm abuts the supporting portion.

In certain embodiments, the insulating body is provided with an insertion surface opposite to the mounting surface, the insertion surface is concavely provided with an insertion slot, and the insertion slot is in communication with the terminal slots for insertion of the mating device therein.

Compared with the related art, the electrical connector according to certain embodiments of the present invention has the following beneficial effects.

The grounding sheet has a connecting arm and a plurality of abutting portions abutting the mounting surface. Each of the abutting portions is located at one side of a corresponding one of the terminal slots. The elastic sheet is located at an opening of one of the terminal slots and provided at one side of a corresponding one of the abutting portions. At least one terminal is mounted to the insulating body from a backward-from-front direction. The terminal abuts the elastic sheet, and the terminal has a contact portion entering the corresponding one of the terminal slots to be electrically connected to the mating device. Thus, a force generated by the abutting portions and the mounting surface abutting each other and a force generated by the elastic sheet and the terminal abutting each other are directed to opposite directions and counteract to each other, thereby avoiding bending of the connecting arm of the grounding sheet in the assembling process, such that the grounding sheet is be in good contact with the terminal to reduce signal interference and achieve a good high frequency transmission effect.

These and other aspects of the present invention will become apparent from the following description of the preferred embodiment taken in conjunction with the following drawings, although variations and modifications therein may be effected without departing from the spirit and scope of the novel concepts of the disclosure.

BRIEF DESCRIPTION OF THE DRAWINGS

The accompanying drawings illustrate one or more embodiments of the disclosure and together with the written description, serve to explain the principles of the disclosure. Wherever possible, the same reference numbers are used throughout the drawings to refer to the same or like elements of an embodiment, and wherein.

DETAILED DESCRIPTION

Figure 1:
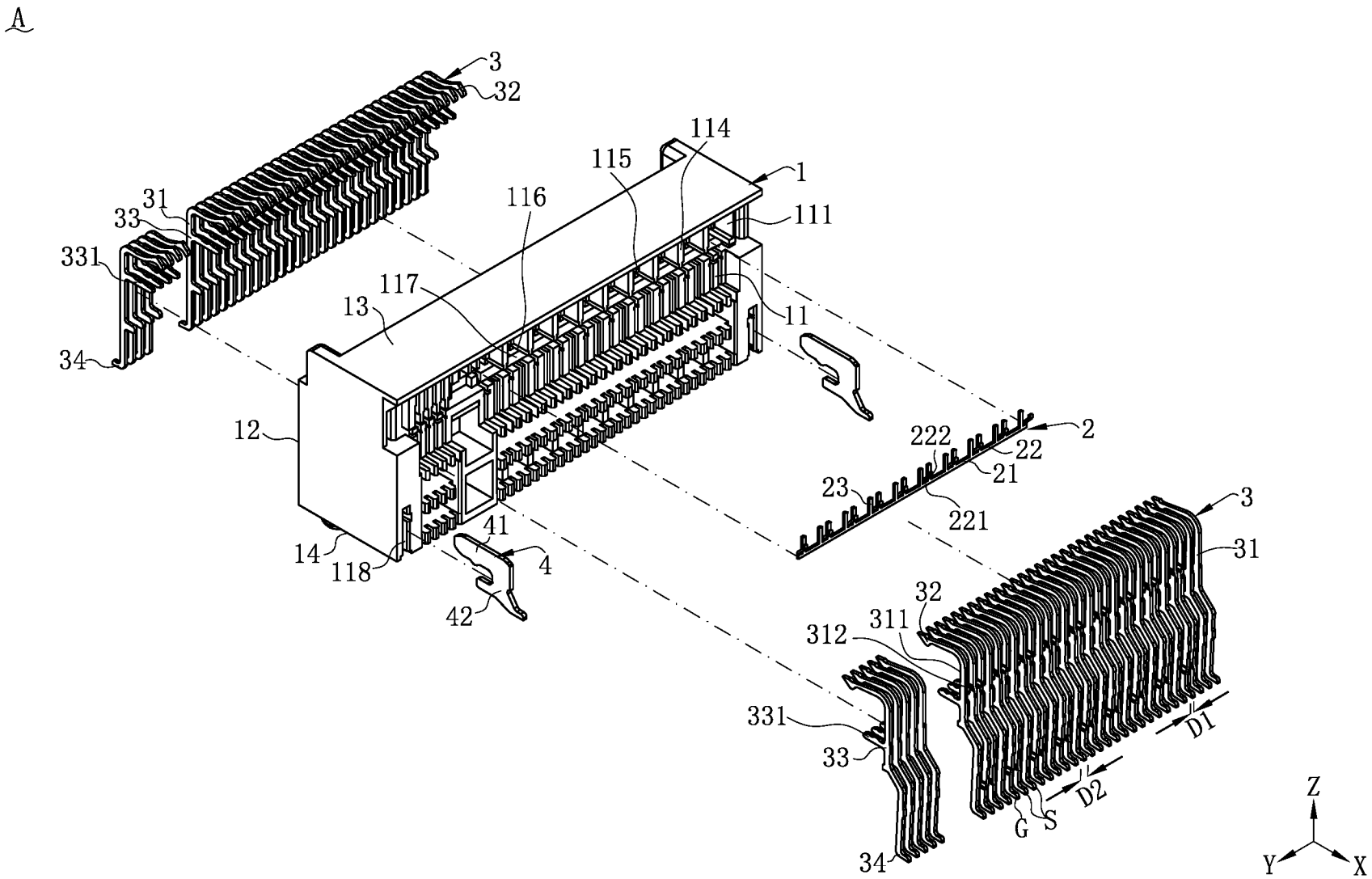
FIG. 1 is a perspective exploded view of an electrical connector according to a first embodiment of the present invention.

The present invention is more particularly described in the following examples that are intended as illustrative only since numerous modifications and variations therein will be apparent to those skilled in the art. Various embodiments of the invention are now described in detail. Referring to the drawings, like numbers indicate like components throughout the views. As used in the description herein and throughout the claims that follow, the meaning of "a", "an", and "the" includes plural reference unless the context clearly dictates otherwise. Also, as used in the description herein and throughout the claims that follow, the meaning of "in" includes "in" and "on" unless the context clearly dictates otherwise. Moreover, titles or subtitles may be used in the specification for the convenience of a reader, which shall have no influence on the scope of the present invention.

It will be understood that when an element is referred to as being "on" another element, it can be directly on the other element or intervening elements may be present therebetween. In contrast, when an element is referred to as being "directly on" another element, there are no intervening elements present. As used herein, the term "and/or" includes any and all combinations of one or more of the associated listed items.

Furthermore, relative terms, such as "lower" or "bottom" and "upper" or "top," may be used herein to describe one element's relationship to another element as illustrated in the Figures. It will be understood that relative terms are intended to encompass different orientations of the device in addition to the orientation depicted in the Figures. For example, if the device in one of the figures is turned over, elements described as being on the "lower" side of other elements would then be oriented on "upper" sides of the other elements. The exemplary term "lower", can therefore, encompasses both an orientation of "lower" and "upper," depending of the particular orientation of the figure. Similarly, if the device in one of the figures is turned over, elements described as "below" or "beneath" other elements would then be oriented "above" the other elements. The exemplary terms "below" or "beneath" can, therefore, encompass both an orientation of above and below.

As used herein, "around", "about" or "approximately" shall generally mean within 20 percent, preferably within 10 percent, and more preferably within 5 percent of a given value or range. Numerical quantities given herein are approximate, meaning that the term "around", "about" or "approximately" can be inferred if not expressly stated.

As used herein, the terms "comprising", "including", "carrying", "having", "containing", "involving", and the like are to be understood to be open-ended, i.e., to mean including but not limited to.

The description will be made as to the embodiments of the present invention in conjunction with the accompanying drawings in FIGS. 1-11. In accordance with the purposes of this invention, as embodied and broadly described herein, this invention, in one aspect, relates to an electrical connector.

FIG. 1 to FIG. 9 show a first embodiment of the present invention. Specifically, a three-dimensional coordinate is defined, in which the X axis is defined as a front-rear direction, the Y axis is defined as a left-right direction, and the Z axis is defined as a vertical direction (i.e., an up-down direction).

Figure 3:
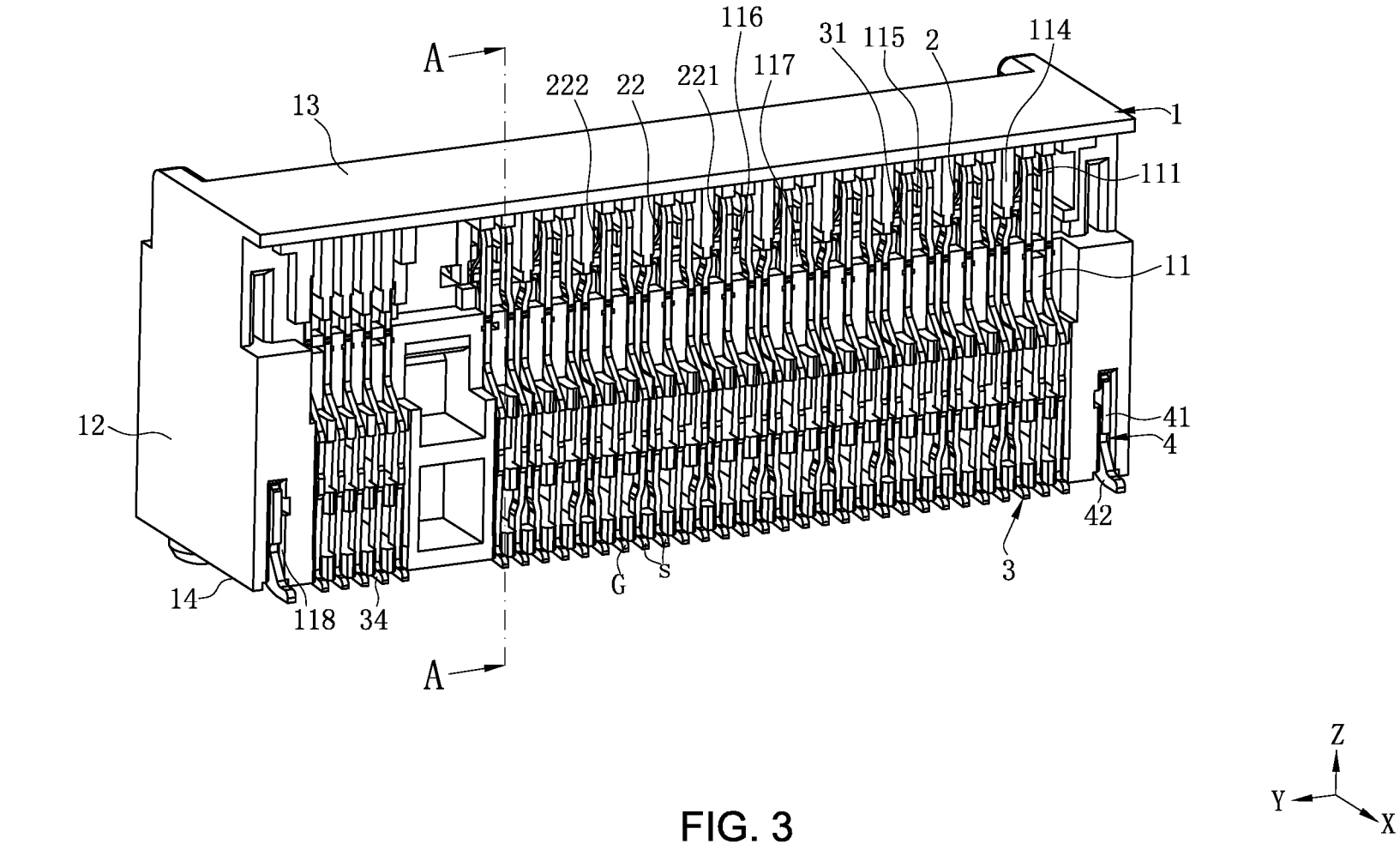
FIG. 3 is a perspective assembled view of the electrical connector according to the first embodiment of the present invention.
Figure 4:
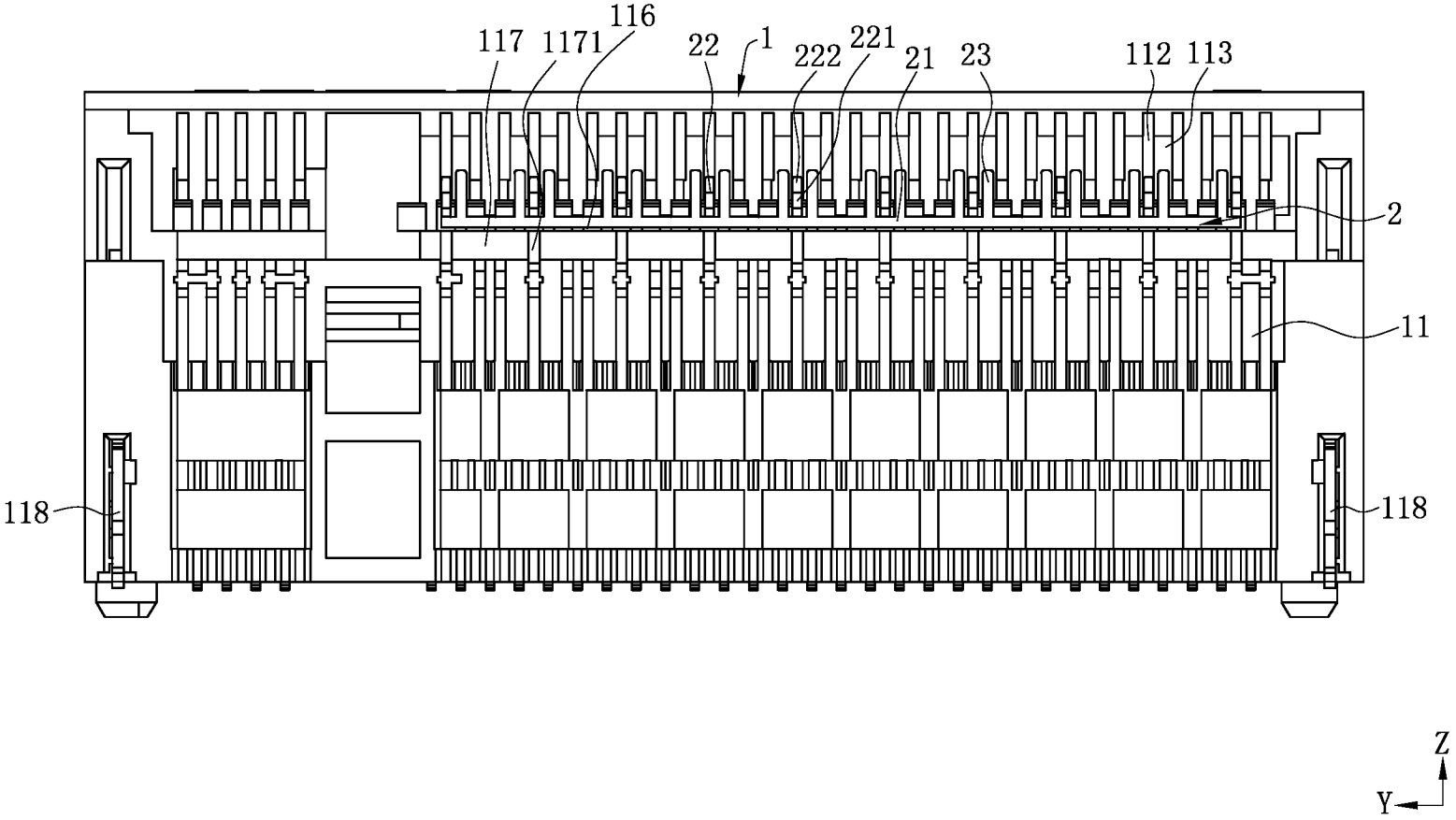
FIG. 4 is a front view of a part of the electrical connector according to the first embodiment in FIG. 3.

As shown in FIG. 1 and FIG. 3, an electrical connector A includes: an insulating body 1, a grounding sheet 2 provided in the insulating body 1, a plurality of terminals 3 provided in the insulating body 1 and abutting the grounding sheet 2, and two fixing members 4 respectively provided at two sides of the insulating body 1 to be soldered to a circuit board (not shown, similarly hereinafter).

As shown in FIG. 2, FIG. 4, FIG. 5 and FIG. 6, the insulating body 1 has a mounting surface 11 and an insertion surface 12 provided opposite to the mounting surface 11. A top surface 13 simultaneously connects the mounting surface 11 and the insertion surface 12, and a bottom surface 14 is located below the top surface 13 and connects the mounting surface 11 and the insertion surface 12. The mounting surface 11 is concavely provided with a plurality of accommodating slots 111 and a plurality of terminal slots 112 at a position close to the top surface 13. The terminal slots 112 are located behind the accommodating slots 111, and a spacing portion 114 exists between the two adjacent accommodating slots 111. A distance between two adjacent spacing portions 114 is identical. Each of two sides of each spacing portion 114 is provided with a protruding block 115. The protruding blocks 115 are provided in the accommodating slots 111 to stop the terminals 3. The terminal slots 112 are in communication with the accommodating slots 111 to accommodate the terminals 3. A gap distance between the two adjacent terminal slots 112 is identical, and a rib 113 is provided between the two adjacent terminal slots 112 to abut the grounding sheet 2. The mounting surface 11 is further concavely provided with an elongated through slot 116. The through slot 116 is located below the accommodating slots 111, and the through slot 116 runs through the accommodating slots 111. A supporting portion 117 is located on an inner bottom wall of the through slot 116 to upward stop the grounding sheet 2. The supporting portion 117 is provided with a plurality of grooves 1171. An inner wall surface of each of the grooves 1171 is an inclined surface. The mounting surface 11 is provided with two fixing grooves 118 at a position close to the bottom surface 14. The fixing grooves 118 are concavely provided backward from the mounting surface 11 and run downward through the bottom surface 14. The two fixing grooves 118 are used for insertion of the fixing members 4 therein. The insertion surface 12 is concavely provided with an elongated insertion slot 121 at a position close to the top surface 13. The insertion slot 121 is in communication with the terminal slots 112 for insertion of a mating device therein.

As shown in FIG. 2, FIG. 5, FIG. 8 and FIG. 9, the grounding sheet 2 is plate shaped, and is accommodated in a corresponding accommodating slot 111. The grounding sheet 2 has an elongated connecting arm 21. The connecting arm 21 is accommodated in the through slot 116, and the connecting arm 21 abuts the inner wall surface of the through slot 116. A side of the connecting arm 21 close to the top surface 13 extends to form a plurality of elastic sheets 22. The elastic sheets 22 are located in front of the ribs 113 and extend from the connecting arm 21 toward openings of the accommodating slots 111. Each of the elastic sheets 22 is provided with an extending portion 221. The extending portions 221 bend and extend toward the openings of the accommodating slots 111. One end of each of the extending portions 221 is connected to the connecting arm 21, and the other end of each of the extending portions 221 is connected to an urging portion 222. The urging portions 222 abut the terminals 3. The side of the connecting arm 21 close to the top surface 13 extends upward to form a plurality of abutting portions 23. The abutting portions 23 are provided on at least one side of the elastic sheets 22. The abutting portions 23 are located in front of the ribs 113 and abut the ribs 113. A first gap D3 exists between the two adjacent abutting portions 23. A second gap D4 exists between one elastic sheet 22 and its adjacent abutting portion 23. The first gap D3 is greater than the second gap D4.

Figure 8:
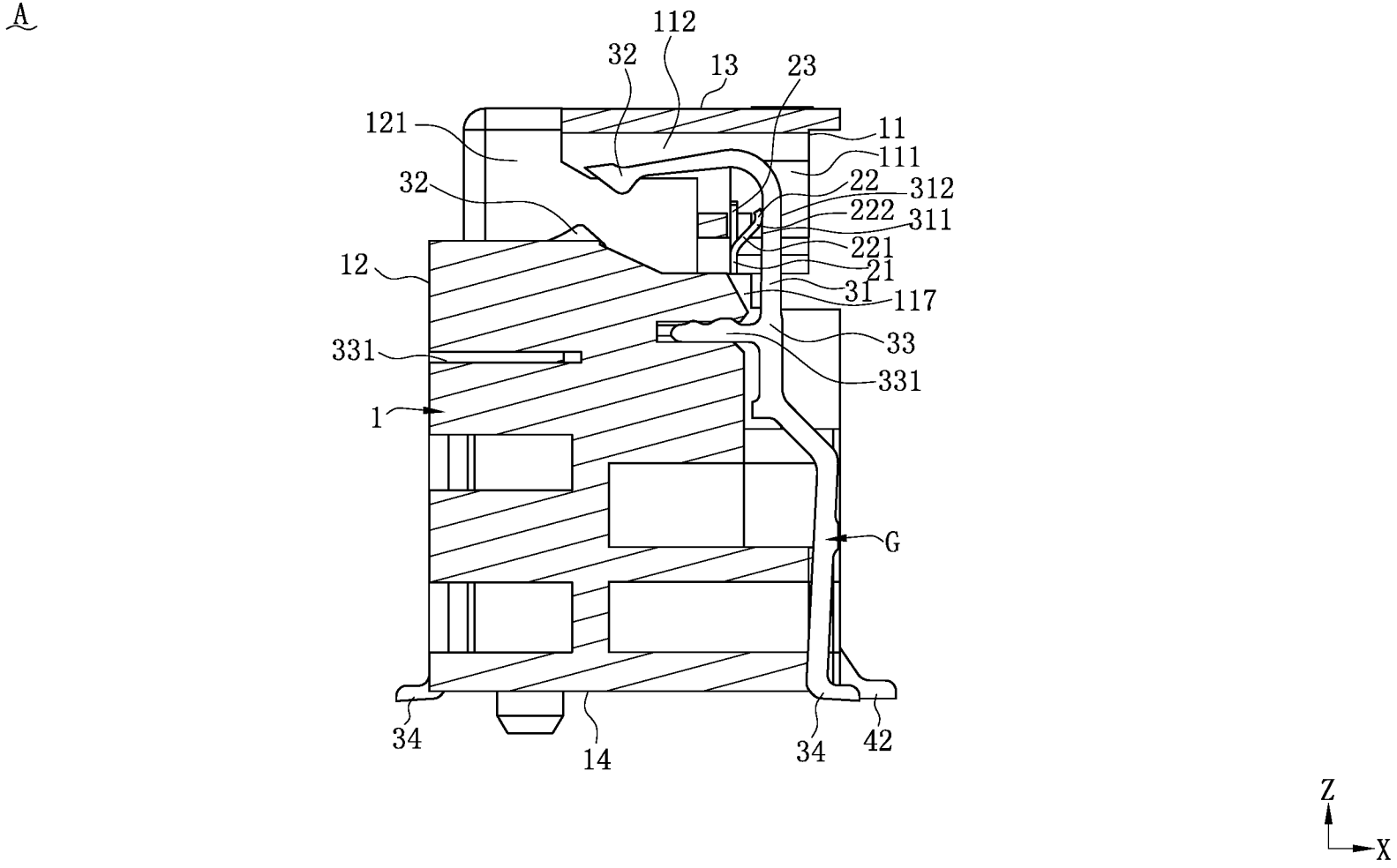
FIG. 8 is a sectional view of the electrical connector in FIG. 3 in the A-A direction according to the first embodiment.
Figure 9:
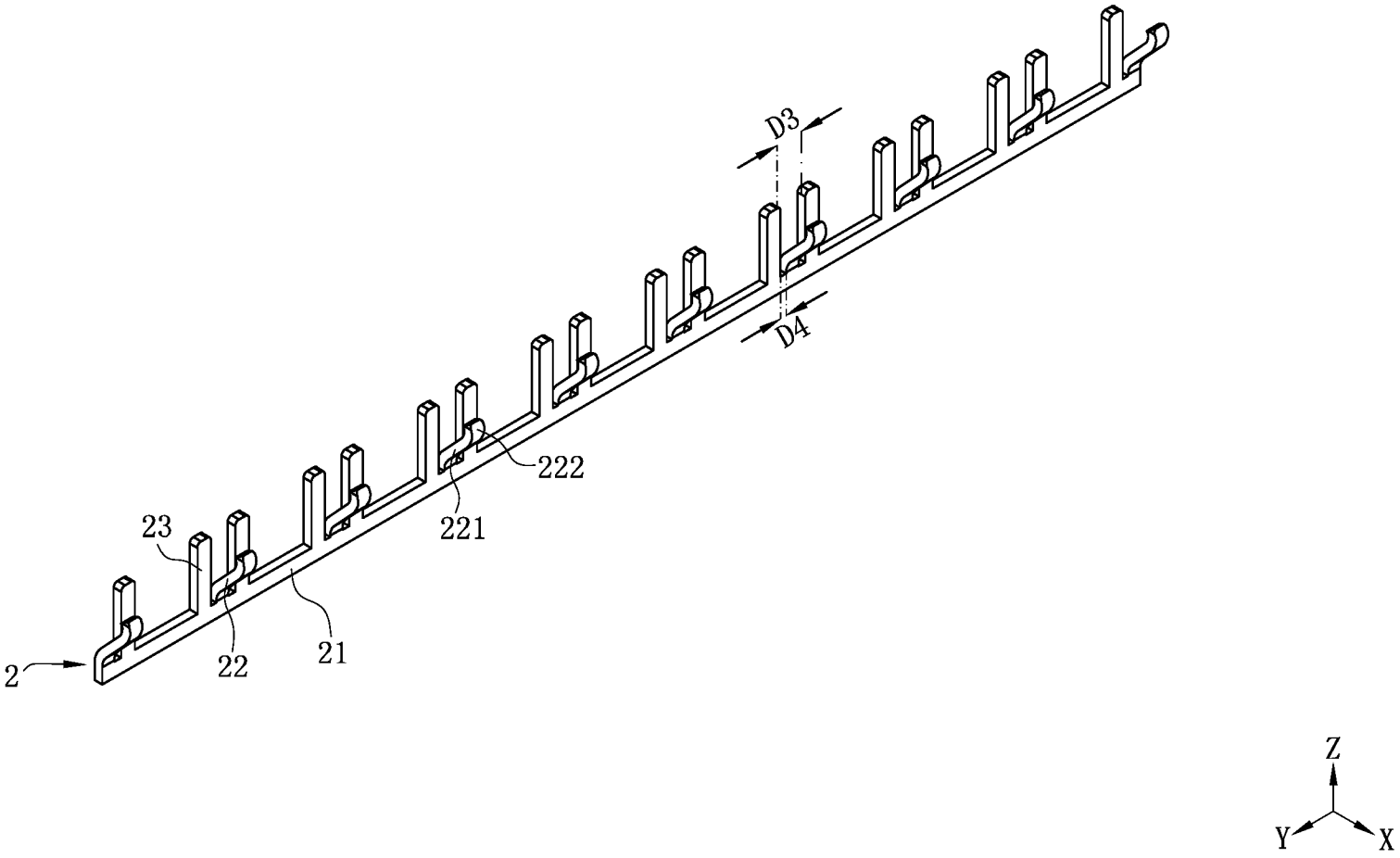
FIG. 9 is a perspective view of the grounding sheet according to the first embodiment of the present invention.

As shown in FIG. 1 and FIG. 8, the terminals 3 are provided in two rows. The terminals 3 in one row are mounted into the insulating body 1 along a backward-from-front direction, and the terminals 3 in the other row are mounted into the insulating body 1 along a forward-from-back direction of the insertion surface 12. Each of the terminals 3 has a base 31. A side of the base 31 adjacent to the corresponding terminal slot 112 has an inner sidewall 311, and a side of the base 31 away from the corresponding terminal slot 112 has an outer sidewall 312. The bases 31 of the terminals 3 in one row enter the accommodating slots 111, and the inner sidewalls 311 thereof abut the urging portions 222. The bases 31 of the terminals 3 in the other row abut the insulating body 1. The base 31 bends upward to form a contact portion 32. The contact portions 32 of the terminals 3 in one row are inserted into the terminal slots 112 and are downward exposed from the upper surface of the insertion slot 121 to mate with the mating device. The contact portions 32 of the terminals 3 in the other row are inserted into the insulating body 1 and are upward exposed from the lower surface of the insertion slot 121 to mate with the mating device. The base 31 extends downward to form a fixing portion 33, and the fixing portion 33 is provided with a clamping rod 331. The clamping rods 331 of the terminals 3 are in interference fit with the insulating body 1 to fix the terminals 3 in the insulating body 1. The fixing portion 33 extends downward to form a soldering portion 34 to perform flat soldering on the circuit board.

As shown in FIG. 3, the terminals 3 include a plurality of signal terminals S and a plurality of ground terminals G. The signal terminals S are provided in pairs. The ground terminals G are provided between two adjacent pairs of signal terminals S. A distance between the bases 31 of the two adjacent signal terminals is greater than a distance between the fixing portions 33 of the two adjacent signal terminals S. The two adjacent signal terminals S are provided at two sides of each of the spacing portions 114. The spacing portions 114 are used to clamp the signal terminals S. The protruding blocks 115 are used to stop the bases 31 of the signal terminals S to prevent the signal terminals S from being excessive inserted. The inner sidewalls 311 of the ground terminals G are used to abut the elastic sheets 22, thereby forming ground loops.

Figure 2:
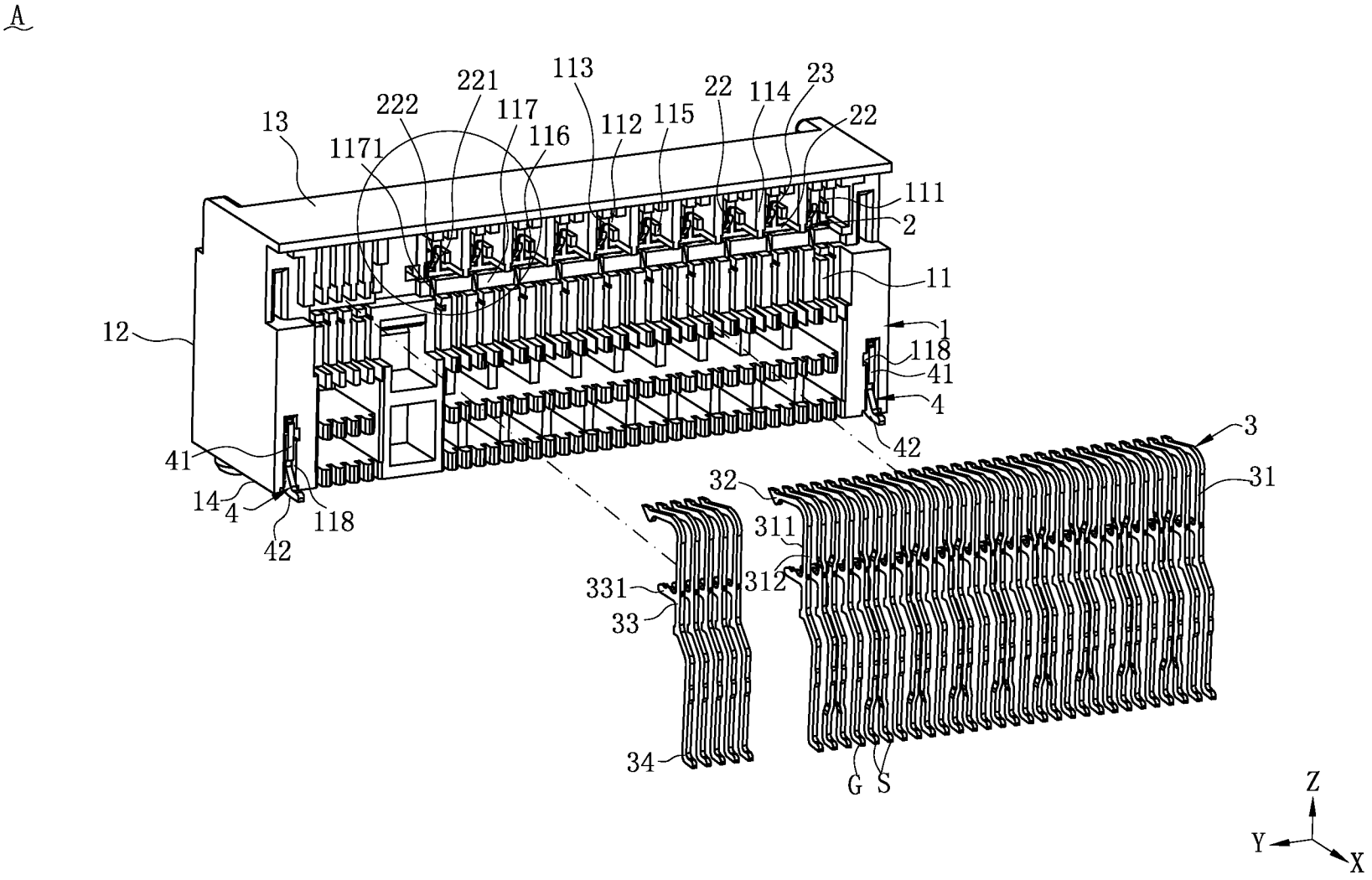
FIG. 2 is a partially perspective exploded view of the electrical connector according to the first embodiment of the present invention.

As shown in FIG. 1 and FIG. 2, each of the fixing members 4 has a flat plate portion 41 and a soldering leg 42. The flat plate portions 41 are provided in the fixing grooves 118 and are in interference fit with the insulating body 1 to fix the fixing members 4. The soldering legs 42 are exposed from the bottom surface 14 and are flat soldered on the circuit board.

Figure 5:
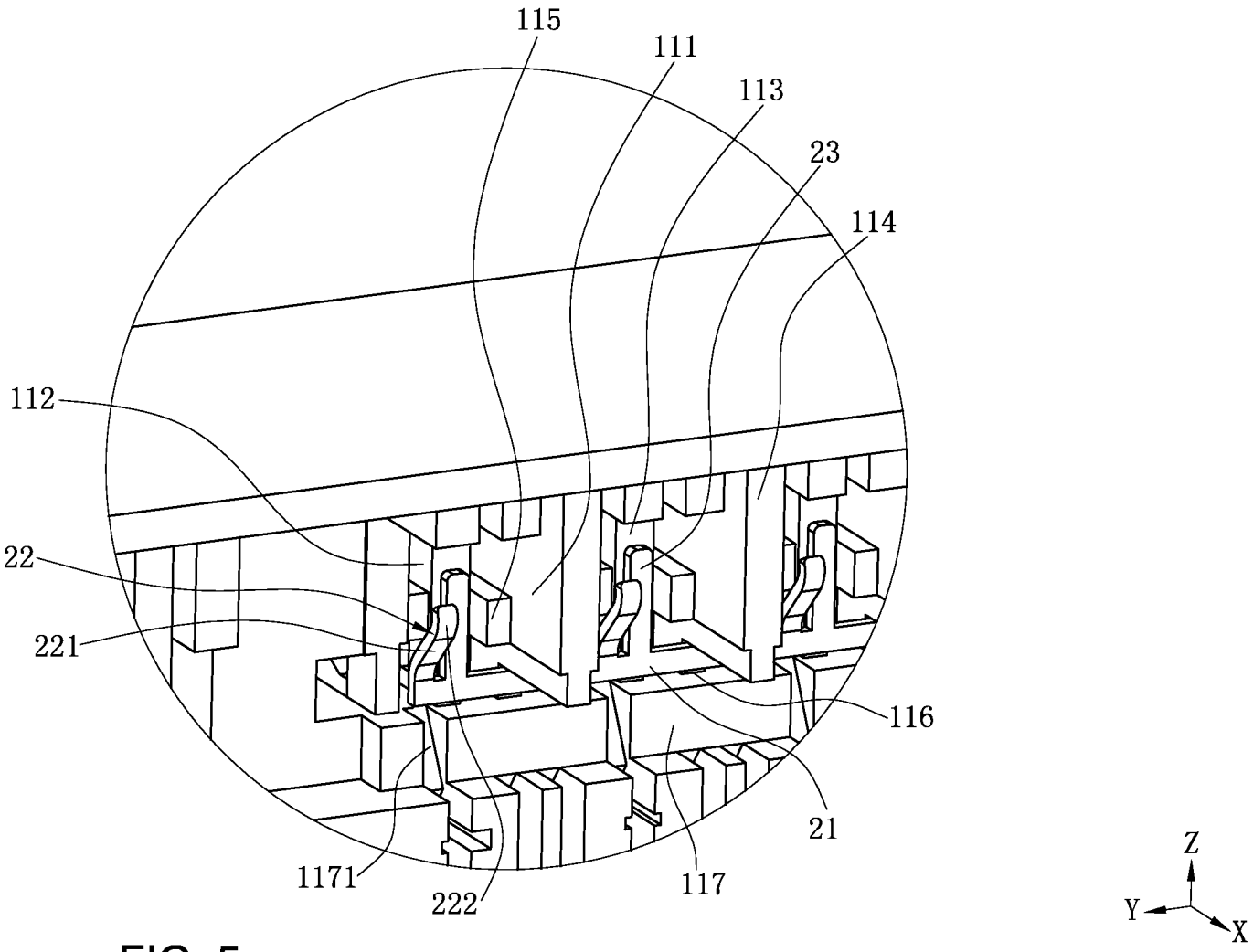
FIG. 5 is a partially enlarged view of a part B of the electrical connector according to the first embodiment in FIG. 2.
Figure 6:
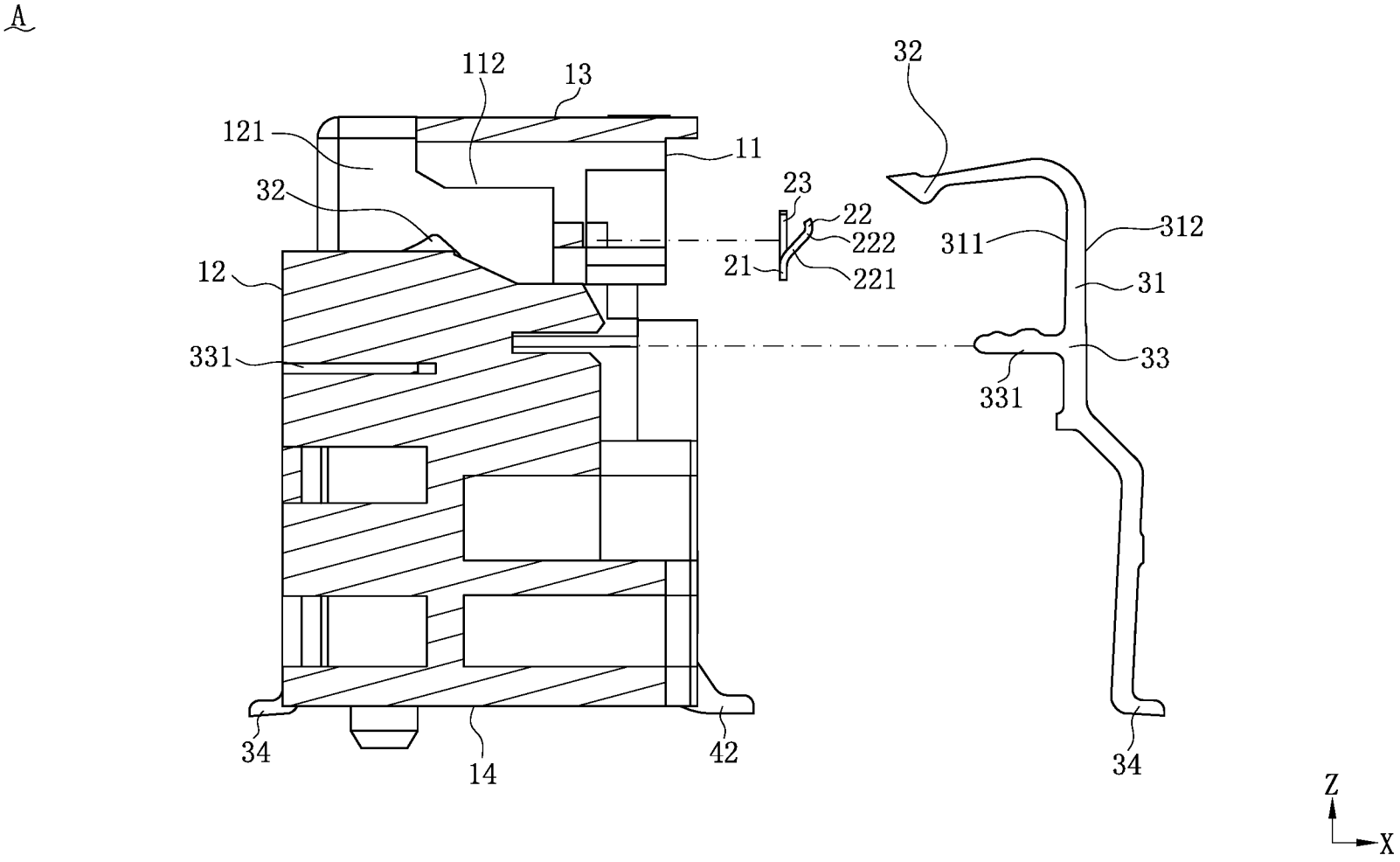
FIG. 6 is a sectional view of the electrical connector in FIG. 3 in an A-A direction before a grounding sheet is inserted into an insulating body according to the first embodiment.
Figure 7:
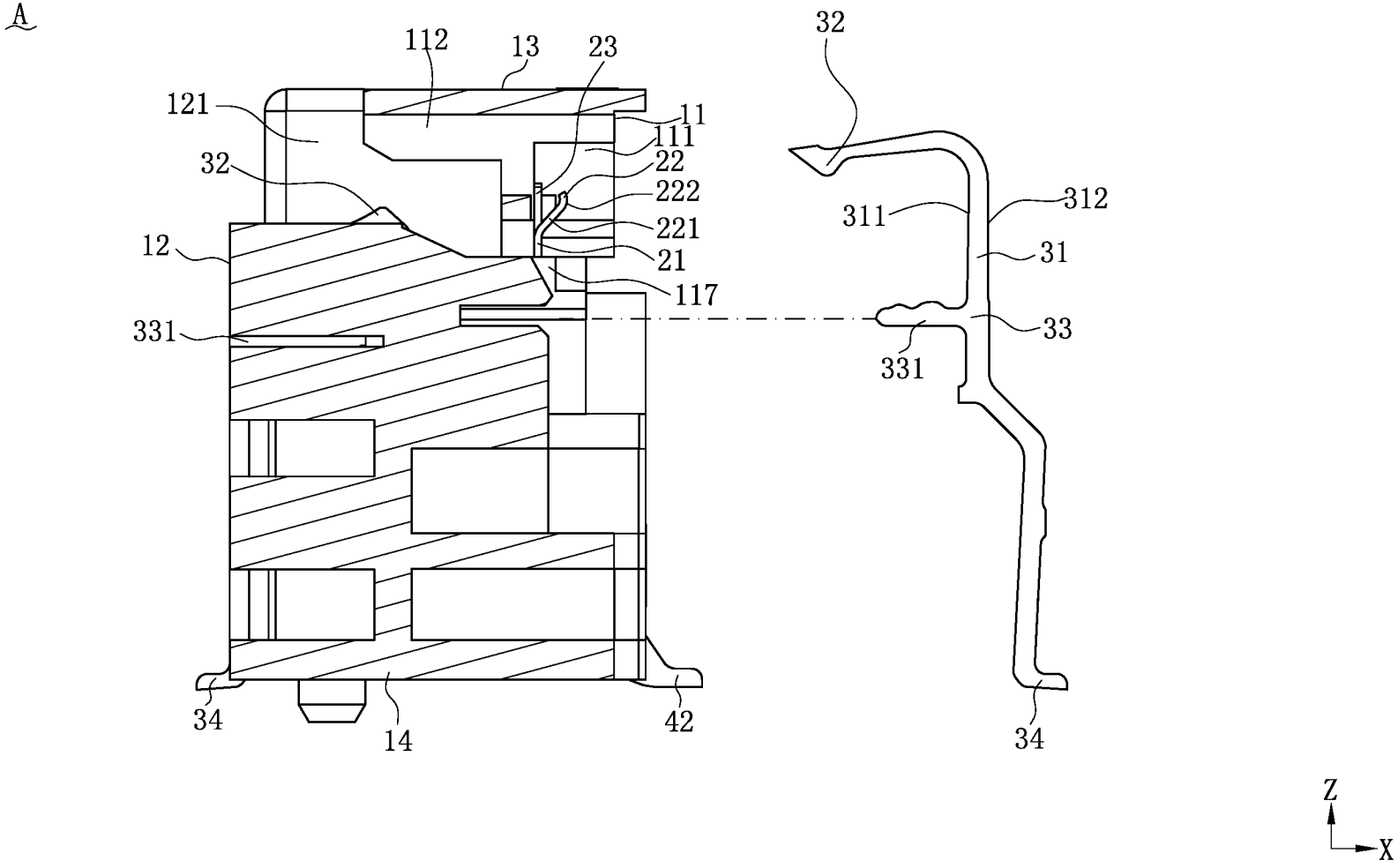
FIG. 7 is a sectional view of the electrical connector in FIG. 3 in the A-A direction when the grounding sheet is inserted into the insulating body according to the first embodiment.

As shown in FIG. 2, FIG. 5 and FIG. 7, when the grounding sheet 2 is accommodated in the corresponding accommodating slot 111, the abutting portions 23 and the connecting arm 21 abut the insulating body 1, and the abutting portions 23 and the connecting arm 21 are located on a same plane in a vertical direction. The connecting arm 21 downward abuts the supporting portion 117, thereby preventing the grounding sheet 2 from falling downward.

As shown in FIG. 8, when the terminals 3 are inserted into the insulating body 1, the connecting arm 21 backward abuts the insulating body 1 and downward abuts the supporting portion 117. The abutting portions 23 backward abut the insulating body 1. The bases 31 are accommodated in the accommodating slots 111. The inner sidewalls 311 of the ground terminals G abut the urging portions 222. The clamping rods 331 are in interference fit with the insulating body 1, thereby fixing the terminals 3 in the insulating body 1.

Figure 10:
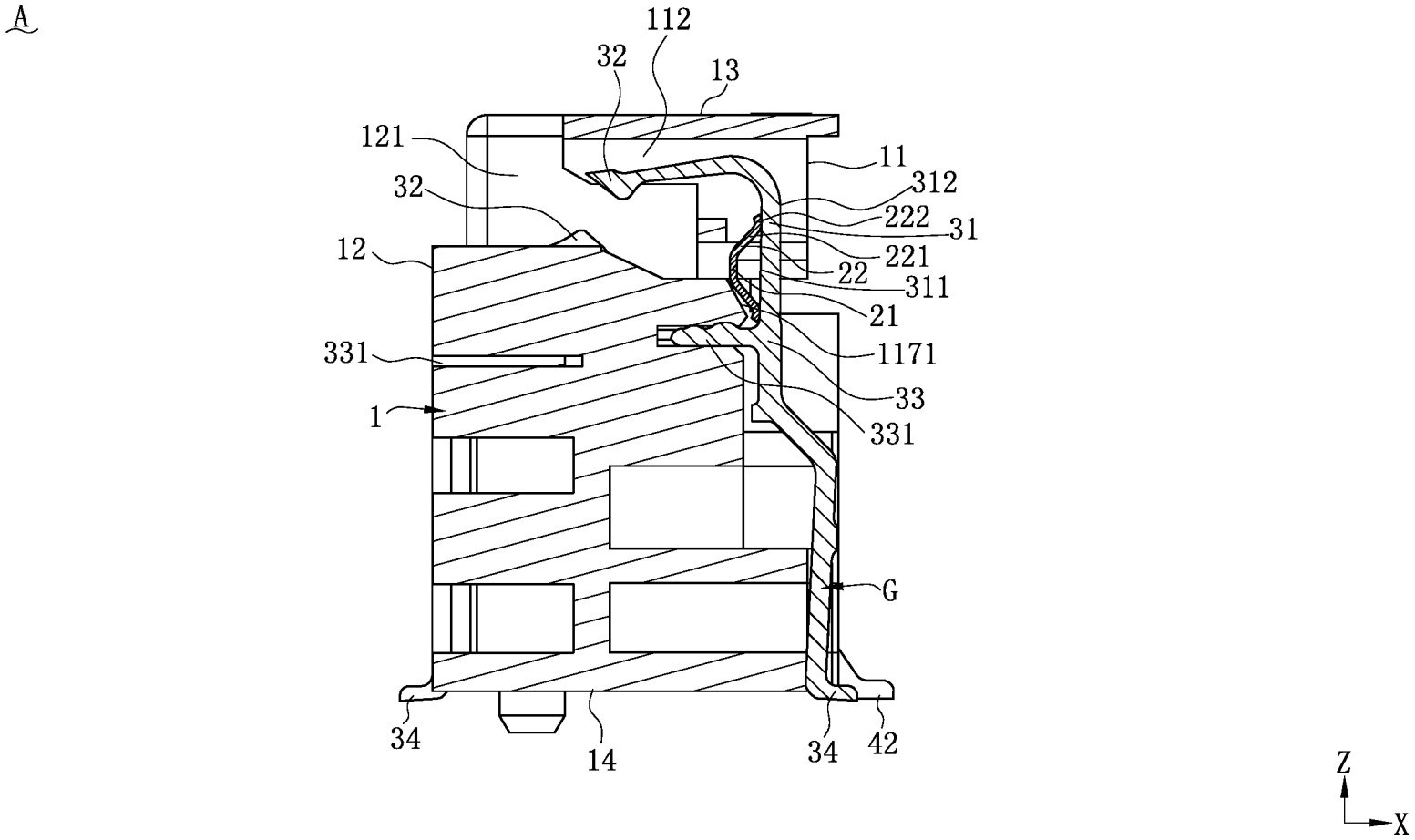
FIG. 10 is a sectional view according to a second embodiment of the present invention.
Figure 11:
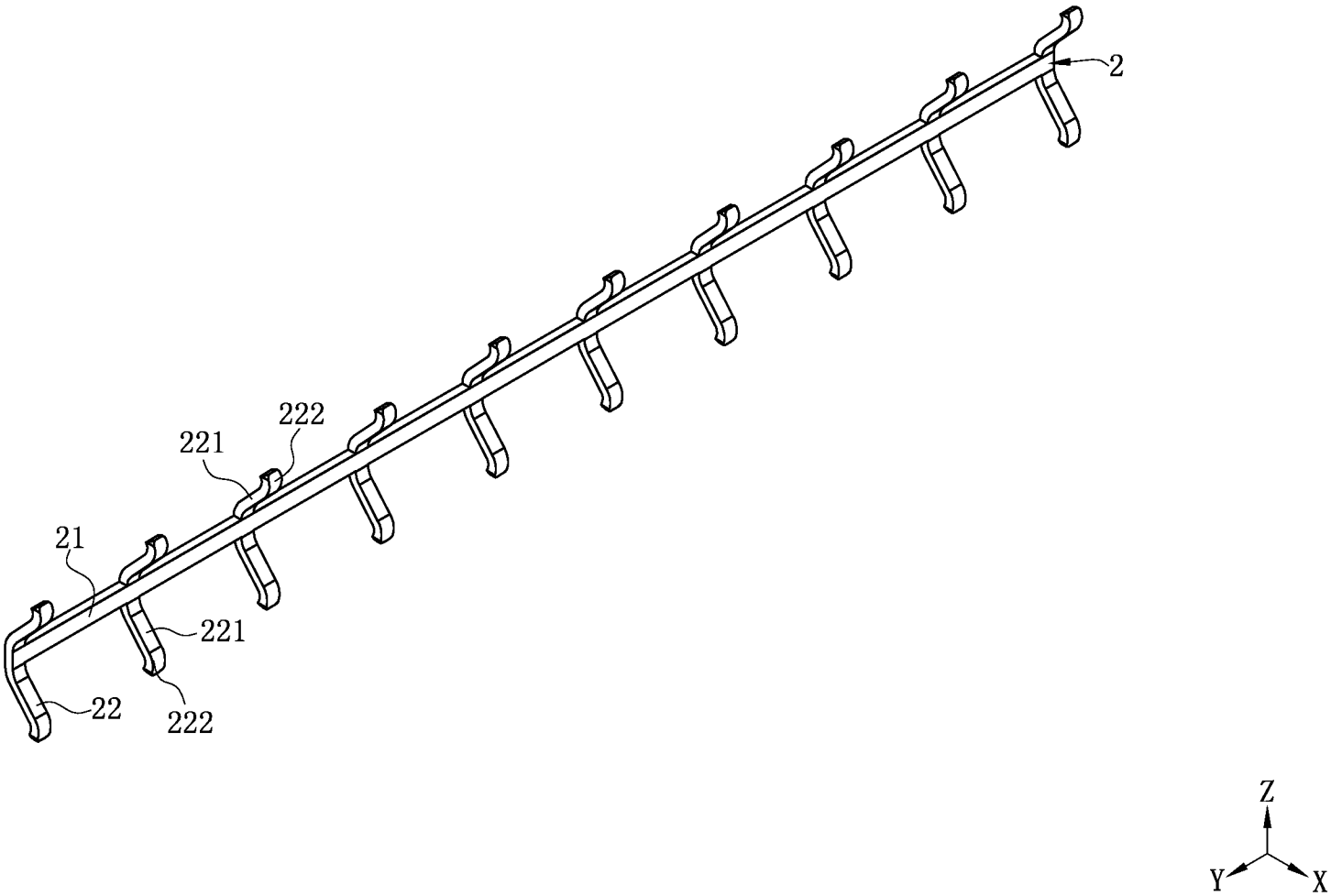
FIG. 11 is a perspective view according to the second embodiment of the present invention.

FIG. 10 and FIG. 11 show an electrical connector A according to a second embodiment of the present invention, which is different from the electrical connector A according to the first embodiment in that: the grounding sheet 2 has the connecting arm 21, and two rows of elastic sheets 22 are symmetrically provided at two sides of the connecting arm 21. The connecting arm 21 abuts the insulating body 1, and the urging portions 222 of the two rows of elastic sheets 22 abut the inner sidewalls 311 of the ground terminals G. The elastic sheets 22 in the lower row are accommodated in the grooves 1171, and the grooves 1171 are used to stop the extending portions 221 of the elastic sheets 22 in the lower row.

To sum up, the electrical connector according to certain embodiments of the present invention has the following beneficial effects:

(1) The grounding sheet 2 has a connecting arm 21 and a plurality of abutting portions 23 abutting the mounting surface. Each of the abutting portions 23 is located at one side of a corresponding one of the terminal slots 112. The elastic sheet 22 is provided between two of the abutting portions 23 and located at an opening of the corresponding one of the terminal slots 112. At least one terminal 3 is mounted to the insulating body 1 along a backward-from-front direction. The terminal 3 abuts the elastic sheet 22, and the terminal 3 has a contact portion 32 entering the corresponding one of the terminal slots 112 to be electrically connected to the mating device. Thus, a force generated by the abutting portions 23 and the mounting surface 11 abutting each other and a force generated by the elastic sheet 22 and the terminal 3 abutting each other are directed to opposite directions and counteract to each other, thereby avoiding bending of the connecting arm 21 of the grounding sheet 2 in the assembling process, such that the grounding sheet 2 is be in good contact with the terminal 3 to reduce signal interference and achieve a good high frequency transmission effect.

(2) The insulating body 1 has a plurality of terminal slots 112, and a rib 113 exists between each two adjacent terminal slots 112. The grounding sheet 2 is accommodated in the corresponding accommodating slots 111. The grounding sheet 2 includes at least one abutting portion 23 located in front of the ribs 113. At least one elastic sheet 22 extends from the connecting arm 21 toward the openings of the accommodating slots 111. The ribs 113 are used to abut the connecting arm 21 to generate one acting force, and the elastic sheet 22 is used to abut the terminal 3 to generate another acting force. The two forces counteract with each other to prevent the grounding sheet 2 from bending from the middle thereof in the assembling process of the grounding sheet 2, thereby enabling the grounding sheet 2 to be in good contact with the terminal 3.

(3) The inner wall surfaces of the grooves 1171 are inclined, which may be used to accommodate the elastic sheets 22 in the lower row, and to enhance the strength of the grooves 1171 of the insulating body 1.

(4) The first distance D1 between the fixing portions 33 of the two adjacent signal terminals S is greater than the second distance D2 between the fixing portion 33 of one signal terminal S and the fixing portion 33 of an adjacent ground terminal G, thereby improving the anti-interference performance of the signal terminals S and increasing the high frequency signal transmission quality of the electrical connector A.

(5) The two adjacent signal terminals S are respectively provided at two sides of each of the spacing portions 114, and the spacing portions 114 may clamp the signal terminals S, such that the signal terminals S may be inserted from normal positions to reduce the processing strength.

(6) The protruding blocks 115 are provided at two sides of the spacing portions 114 to stop the signal terminals S, preventing the signal terminals S from being excessively inserted.

The foregoing description of the exemplary embodiments of the invention has been presented only for the purposes of illustration and description and is not intended to be exhaustive or to limit the invention to the precise forms disclosed. Many modifications and variations are possible in light of the above teaching.

The embodiments were chosen and described in order to explain the principles of the invention and their practical application so as to activate others skilled in the art to utilize the invention and various embodiments and with various modifications as are suited to the particular use contemplated. Alternative embodiments will become apparent to those skilled in the art to which the present invention pertains without departing from its spirit and scope. Accordingly, the scope of the present invention is defined by the appended claims rather than the foregoing description and the exemplary embodiments described therein.

What is claimed is:

1. An electrical connector, comprising:

an insulating body, having a mounting surface, a plurality of ribs, and a plurality of terminal slots concavely provided on the mounting surface, wherein each of the ribs is provided between two adjacent ones of the terminal slots;

a grounding sheet, having a connecting arm and a plurality of abutting portions abutting the ribs, wherein each of the abutting portions is located at one side of a corresponding one of the terminal slots, an elastic sheet is located at an opening of one of the terminal slots, and the elastic sheet is provided at one side of a corresponding one of the abutting portions; and at least one terminal, mounted to the insulating body along a backward-from-front direction, wherein the terminal abuts the elastic sheet, and the terminal has a contact portion entering a corresponding one of the terminal slots to be electrically connected to a mating device.

2. The electrical connector according to claim 1, comprising a plurality of terminals, wherein the terminals comprise a plurality of signal terminals and a plurality of ground terminals, the signal terminals are provided in pairs, and the ground terminals are provided at two sides of one of the pairs of the signal terminals.

3. The electrical connector according to claim 2, wherein each of the terminals has a base located below the contact portion, a side of the base adjacent to the corresponding one of the terminal slots has an inner sidewall, a side of the base away from the corresponding one of the terminal slots has an outer sidewall; and the elastic sheet abuts the inner sidewall of each of the ground terminals.

4. The electrical connector according to claim 2, wherein each of the terminals has a base, the base has a fixing portion extending downward, a first distance exists between the fixing portions of the two adjacent signal terminals, a second distance exists between the fixing portion of one of the signal terminals and the fixing portion of an adjacent one of the ground terminals, and the first distance is less than the second distance.

5. The electrical connector according to claim 3, wherein one side of the connecting arm extends to form the abutting portions and a plurality of elastic sheets, a side of each of the abutting portions located in the corresponding one of the terminal slots abuts the mounting surface, and the elastic sheets are located in front of the terminal slots and abut inner sidewalls of the ground terminals.

6. The electrical connector according to claim 1, wherein a first gap exists between the two adjacent ones of the abutting portions, a second gap exists between one of the elastic sheets and an adjacent one of the abutting portions, and the first gap is greater than the second gap.

7. The electrical connector according to claim 3, wherein two sides of the connecting arm symmetrically extend to form two rows of elastic sheets, and the two rows of elastic sheets are located in front of the terminal slots and abut inner sidewalls of the ground terminals.

8. The electrical connector according to claim 3, wherein the elastic sheet is provided with an extending portion and an urging portion bending and extending from the extending portion toward the base, and the urging portion abuts inner sidewalls of the ground terminals.

9. The electrical connector according to claim 1, wherein the mounting surface is provided with a supporting portion located below the terminal slots, and the connecting arm abuts the supporting portion.

10. The electrical connector according to claim 9, wherein the supporting portion is provided with at least one groove corresponding to the elastic sheet, and an inner wall surface of the groove is an inclined surface configured to accommodate the elastic sheet.

11. An electrical connector, comprising:

an insulating body, provided with a mounting surface, wherein the mounting surface is concavely provided with at least one accommodating slot and a plurality of terminal slots, the terminal slots are in communication with the accommodating slot, and a rib is provided between two adjacent ones of the terminal slots;

a grounding sheet, accommodated in the accommodating slot, wherein the grounding sheet comprises at least one abutting portion located in front of the rib and abutting the rib, at least one elastic sheet provided in front of the terminal slots and extending toward an opening of the accommodating slot, and a connecting arm connecting the abutting portion and the elastic sheet; and at least one terminal, mounted to the insulating body along a backward-from-front direction, wherein the terminal has a base entering the accommodating slot and abutting the elastic sheet, and the base has a contact portion inserted into a corresponding one of the terminal slots and electrically connected to a mating device.

12. The electrical connector according to claim 11, wherein a side of the base adjacent to the corresponding one of the terminal slots has an inner sidewall, a side of the base away from the corresponding one of the terminal slots has an outer sidewall; and the elastic sheet abuts the inner sidewall.

13. The electrical connector according to claim 11, wherein the mounting surface is provided with a plurality of accommodating slots, and a spacing portion exists between two adjacent ones of the accommodating slots.

14. The electrical connector according to claim 13, comprising a plurality of terminals, wherein the terminals comprise a plurality of signal terminals and a plurality of ground terminals, the signal terminals are provided in pairs, two adjacent ones of the signal terminals are provided at two sides of the spacing portion, and the ground terminals are provided at two sides of one of the pairs of the signal terminals.

15. The electrical connector according to claim 13, wherein the two sides of the spacing portion are provided with two protruding blocks, and the protruding blocks are provided below the terminal slots to prevent the signal terminals from being excessively inserted.

16. The electrical connector according to claim 11, wherein the mounting surface is provided with an elongated through slot and a plurality of accommodating slots, the through slot is provided below the accommodating slots and simultaneously runs through the accommodating slots; and the connecting arm is accommodated in the through slot.

17. The electrical connector according to claim 16, wherein the mounting surface is further provided with an elongated supporting portion located below the through slot, and the connecting arm abuts the supporting portion.

18. The electrical connector according to claim 11, wherein the insulating body is provided with an insertion surface opposite to the mounting surface, the insertion surface is concavely provided with an insertion slot, and the insertion slot is in communication with the terminal slots for insertion of the mating device therein.

* * * * *